US005511566A

United States Patent [19]

Brand

[11] Patent Number: 5,511,566

[45] Date of Patent: Apr. 30, 1996

[54] DISTRIBUTOR FOR PARTICLES OF TOBACCO AND THE LIKE

[75] Inventor: Peter Brand, Hamburg, Germany

[73] Assignee: Hauni Maschinenbau AG, Hamburg, Germany

[21] Appl. No.: 252,958

[22] Filed: Jun. 2, 1994

[51] Int. Cl.[6] ..... A24C 5/39

[52] U.S. Cl. ..... 131/109.3; 131/108

[58] Field of Search ..... 131/108, 109.1–110; 198/752, 754

[56] References Cited

U.S. PATENT DOCUMENTS

| | | | |
|---|---|---|---|
| 2,318,588 | 5/1943 | Arelt . | |
| 2,340,914 | 2/1944 | Whitaker . | |
| 4,601,297 | 7/1986 | Mattei et al. | 131/109.3 |
| 4,616,663 | 10/1986 | Lorenzen . | |
| 5,115,819 | 5/1992 | Wochnowski | 131/109.3 |

FOREIGN PATENT DOCUMENTS

| | | |
|---|---|---|
| 843043 | 8/1960 | United Kingdom . |

*Primary Examiner*—Jennifer Bahr
*Attorney, Agent, or Firm*—Darby & Darby

[57] ABSTRACT

A tobacco distributor wherein a flow of tobacco particles is delivered to a rotary carded drum by a duct which is at least substantially horizontal so that the overall height of the distributor can be reduced accordingly. The duct comprises or cooperates with devices which segregate fragments of rock and/or fragments of metallic material from the flow which is being advanced into the range of the carding on the drum. The latter converts the flow into a carpet which is ready to be transformed into one or more continuous rod-shaped fillers. The duct is agitated to promote the advancement of the flow from its receiving section to its discharge end at the carded drum.

17 Claims, 2 Drawing Sheets

DISTRIBUTOR FOR PARTICLES OF TOBACCO AND THE LIKE

BACKGROUND OF THE INVENTION

The invention relates to apparatus for processing particles of smokable material, such as fragments of ribs and leaves of natural tobacco, fragments of reconstituted tobacco and/or fragments of artificial tobacco. More particularly, the invention relates to improvements in apparatus known as distributors or hoppers (hereinafter called distributors) which can be utilized to supply particles of tobacco to the rod making stations in machines which serve to turn out cigarettes or other rod-shaped articles of the tobacco processing industry. Still more particularly, the invention relates to improvements in those parts of distributors wherein one or more flows of particles are converted into carpets or layers preparatory to delivery to the rod making stations of machines which are to transform the layers or carpets into rod-shaped fillers to be draped into webs of cigarette paper or other wrapping material.

The overall height of a tobacco rod making machine, such as cigarette maker, depends to a large extent or entirely upon the height of the distributor. The dimensions of the distributor cannot be reduced at will because such apparatus must comprise means for carrying out a number of operations including loosening, spreading, classifying and densifying in order to furnish a layer or carpet which is ready to be converted into the filler of a high-quality cigarette or another rod-shaped smokers' product (hereinafter referred to as cigarette for short). In addition, the distributor must deliver huge quantities of properly treated particles because a modern cigarette maker turns out up to and even well in excess of 10,000 cigarettes per minute. Of course, the quantity of particles to be processed per unit of time is even larger if a single cigarette maker is to simultaneously turn out two or more continuous cigarette rods.

On the other hand, the space in a cigarette making plant is at a premium so that it is highly desirable to reduce the dimensions of the makers, and particularly of their distributors, without undesirably affecting the quality of the layers or carpets which are to be converted into rod-shaped fillers.

OBJECTS OF THE INVENTION

An object of the invention is to provide a distributor which is more compact than but at least as effective as a conventional distributor for use in a maker of cigarettes or other rod-shaped smokers' products.

Another object of the invention is to provide a distributor whose overall height is less than that of a conventional distributor but its output and other desirable parameters at least match those of conventional distributors.

A further object of the invention is to provide the distributor with novel and improved means for delivering comminuted particles of smokable material to the carpet forming station.

An additional object of the invention is to provide the distributor with novel and improved means for manipulating tobacco particles between one or more magazines and the carpet forming station or stations.

Still another object of the invention is to provide a distributor which exhibits the above outlined advantages and can be installed in existing makers of cigarettes or the like as a superior substitute for heretofore known distributors.

A further object of the invention is to provide a rod making machine which embodies the above outlined improved distributor.

Another object of the invention is to provide a production line with one or more cigarette makers which embody the above outlined distributor or distributors.

An additional object of the invention is to provide the distributor with novel and improved means for segregating particles of metal, fragments of rock and/or other undesirable materials from the particles of smokable material.

SUMMARY OF THE INVENTION

The invention is embodied in a distributor for particles of smokable material, such as comminuted tobacco leaves. The improved distributor comprises a carded conveyor which can convert a flow of particles into a carpet or layer, and means for delivering to the conveyor an at least substantially continuous flow of particles. The delivering means comprises a duct having a discharge end at the conveyor, a particle receiving section, and an elongated intermediate section between the receiving section and the discharge end. At least a major part of the intermediate section is at least substantially horizontal, and the distributor further comprises means for agitating at least a portion of the duct to thereby advance the flow in a direction from the receiving section to the discharge end.

The distributor can further comprise means, such as a brush, a comb or a rake, for smoothing the flow of particles at the discharge end of the duct. The carded conveyor can include a drum which is provided with a carding at its periphery and is driven to rotate about a substantially horizontal axis. The smoothing means of such distributor can comprise one or more flow contacting members which are driven to oscillate or reciprocate in at least substantial parallelism with the substantially horizontal axis.

The means for receiving particles from the carded conveyor can include a chute having a sidewall which preferably slopes downwardly from a bottom wall of the duct at the discharge end of the duct and beneath the conveyor.

The bottom wall of the duct can include a portion which constitutes a ramp and slopes downwardly counter to the direction of advancement of the flow from the receiving section toward the discharge end of the duct. The ramp is located at least close to (particularly beneath) the receiving section of the duct. The means for supplying particles to the receiving section of the duct normally feeds a mixture of randomly distributed lighter particles (such as shreds of tobacco leaf laminae) and heavier particles (e.g., fragments of rock and the like). The heavier particles descend onto and advance along the ramp, and such distributor preferably further comprises means (e.g., a vibrating trough or chute) for receiving heavier particles from the ramp.

The particles which are being supplied to the receiving section of the duct often constitute a mixture of magnetizable and nonmagnetizable particles, and such mixture is advanced to the receiving section along a predetermined path, for example, along a vertical or nearly vertical path. The distributor can further comprise one or more permanent magnets which are installed adjacent the path, preferably at or not far away from the receiving section of the duct.

The distributor can further comprise means for monitoring the level of the upper surface of the flow in the duct. Such monitoring means can be designed to generate signals which are utilized to regulate the rate of admission of tobacco particles into the receiving section of the duct if the level of the upper surface of the flow departs from a desirable or optimum level. The monitoring means can be installed at or on or in a top wall of the intermediate section of the duct.

In accordance with one of presently preferred embodiments of the invention, the intermediate section of the duct comprises a substantially horizontal part extending from the receiving section toward but short of the discharge end, and a substantially vertical part extending from the substantially horizontal part to the discharge end of the duct. If the conveyor includes a rotary drum, such drum is preferably rotatable about a substantially horizontal axis and the top portion of the drum is preferably located beneath (e.g., immediately adjacent to) the discharge end of the duct.

The cross-sectional area of the duct can increase at least substantially continuously from the receiving section and preferably all the way or at least close to the discharge end. To this end, the intermediate section of the duct can be designed in such a way that it includes a first wall (e.g., a bottom wall) and a second wall which is located opposite the first wall and diverges from the first wall in the direction of advancement of the flow from the receiving section at least close to the discharge end. The second wall can include or constitute the top wall of the intermediate section of the duct.

The agitating means can comprise an eccentric drive having a connecting rod which includes or constitutes a leaf spring. Such drive can further comprise a rotary eccentric and a strap which surrounds the eccentric and is connected with the leaf spring or leaf springs of the connecting rod.

The novel features which are considered as characteristic of the invention are set forth in particular in the appended, claims. The improved distributor itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
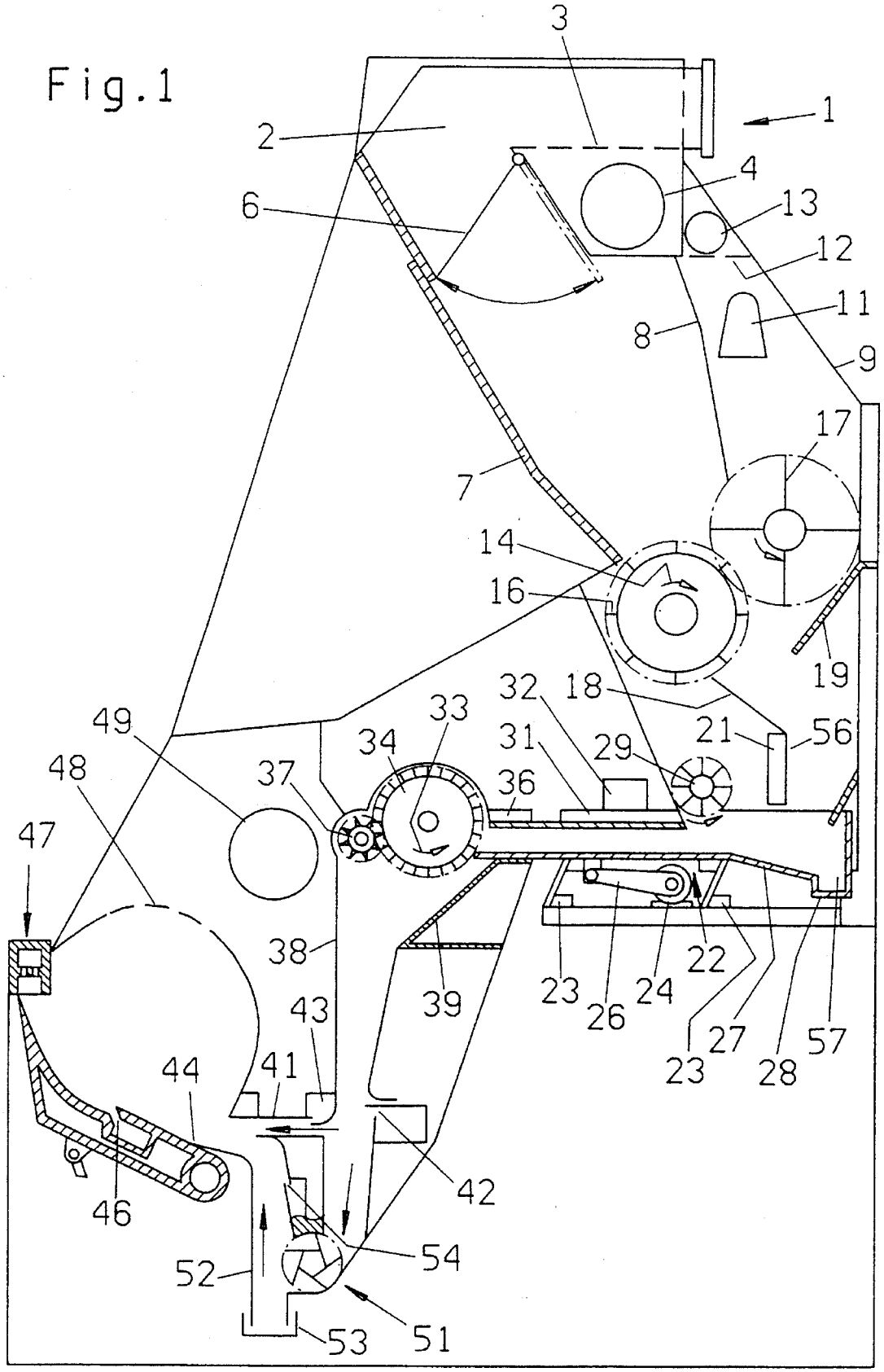
FIG. 1 is a schematic partly elevational and partly vertical sectional view of a distributor or hopper which embodies one form of the invention and wherein the entire intermediate section of the duct is at least substantially horizontal.

FIG. 1 shows certain parts of a distributor or hopper which embodies one form of the invention. The upper part of the housing of the distributor carries the outlet portion of a pneumatic conveyor 1 which serves to deliver a mixture of air and tobacco particles into a chamber 2. The bottom wall of the chamber includes an air-permeable portion 3 and a pivotable gate 6 which can be moved between a closing position (indicated by a solid line) and an open or retracted position (indicated by phantom lines) so that it can deliver batches of tobacco particles into a magazine 7 by gravity flow. The foraminous portion 3 is disposed above the intake of a pipe 4 which draws air from the chamber 2. The gate 6 can be pivoted to the open position in response to signals from a detector (not shown) which monitors the level of the top surface of the supply of particles in the magazine 7.

The magazine 7 is adjacent a compartment 9 which is separated therefrom by a partition 8 and receives tobacco particles by way of a pneumatic conveyor 11. The particles in the compartment 9 are returned from one or more customary trimming or equalizing stations where the streams of tobacco particles are converted into rod-like fillers as a result of removal of surplus tobacco. Reference may be had, for example, to commonly owned U.S. Pat. No. 4,893,640 granted Jan. 16, 1990 to Heitmann et al. for "Multiple-rod cigarette making machine". This patent shows and describes several trimming or equalizing devices which remove surplus particles from tobacco streams. Moreover, the conveyor 11 can serve to deliver certain other types or brands of tobacco particles to be mixed with those leaving the magazine 7. A foraminous partition 12 above the discharge end of the conveyor 11 enables a pneumatic conveyor 13 to evacuate air from the compartment 9.

The lower portion of the magazine contains a portion of a metering device 16 which is driven to rotate in the direction of arrow 14. The device 16 which is shown in FIG. 1 comprises a rotary carrier and pins or studs extending radially outwardly from the periphery of the carrier to entrain tobacco particles from the magazine and to propel the thus entrained particles toward a downwardly sloping ramp 19 at a level below a combing roller 17 (also called picker roller) which is driven to rotate in a counterclockwise direction as viewed in FIG. 1. The pins of the roller 17 draw tobacco particles from the lower portion of the compartment 9 and propel such particles into the lower portion of the magazine 7 wherein the thus propelled particles are mixed with those delivered from the chamber 2. In addition, the roller 17 (which is preferably driven in such a way that its rotational speed is approximately three times the rotational speed of the metering device 16) performs the function of expelling tobacco particles from the pins or studs of the metering device 16 so that the mixture of particles drawn from the magazine 7 and compartment 9 is propelled against the ramp 19.

The ramp 19 is located opposite a downwardly inclined wall 18 to establish therewith a substantially vertical path for a shower of particles which descend onto the receiving section of an elongated duct 22. The particles which are supplied by the metering device 16, combing roller 17, ramp 19 and wall 18 are converted into a flow which is advanced in a direction to the left, as viewed in FIG. 1, into the range of a rotary combing conveyor 34 which cooperates with the duct 22 in accordance with a feature of the present invention. One or more magnets 21 are located adjacent the vertical path for the shower of tobacco particles descending along and beyond the wall 18 to attract metallic particles 56 (if any) upstream of the receiving section of the duct 22. The latter is agitated by an eccentric drive 24 which causes the tobacco particles in the elongated at-least substantially horizontal intermediate section of the duct to form a condensed flow which advances toward the carding at the periphery of the conveyor 34.

The duct is carried by a set of leaf springs 23 which enable the drive 24 to agitate the duct in a sense to convert the descending shower of tobacco particles into a densified flow and to advance the flow toward the discharge end of the duct at the periphery of the conveyor 34. The drive 24 comprises a motor which rotates an eccentric which, in turn, transmits motion to a connecting rod 26 attached to the bottom wall of the duct 22.

That portion of the bottom wall of the duct 22 which is located beneath the receiving section at the magnet or magnets 21 constitutes a ramp 27 which slopes downwardly and rearwardly, i.e., counter to the direction of propagation of the flow toward the conveyor 34. The ramp 27 serves to intercept heavier parts in the descending shower, such as fragments 57 of rock or the like, and to advance the thus intercepted particles toward and into a receiving or collecting device 28, e.g., a vibratory conveyor or simply a trough or gutter which is emptied at necessary intervals. Thus, the duct 22 and the means (16 to 19) for supplying tobacco particles into the receiving section of the duct at the magnet(s) 21 cooperate to ensure that the contents of the descending particles are relieved of metallic parts as well as of heavier impurities which should not reach the rod forming station or stations.

The magnet or magnets 21 are positioned upstream of a rotary combing device 29 which brushes back the surplus above a selected level of the developing flow and is followed by a monitoring device 32 mounted on a top wall 31 of the elongated intermediate section of the duct 22 to generate signals denoting the level of the upper surface of the flow of tobacco particles in the intermediate section. Signals from the monitoring device are utilized to alter the rate of delivery of particles into the duct if the monitoring device detects cavities or other recesses in the advancing flow to thus ensure that the density of the flow reaching the conveyor 34 is constant or always remains within an optimum range. The monitoring device can be located at the top of or can be embedded in the top wall of the intermediate section of the duct 22.

The carded conveyor 34 comprises a rotary cylindrical carrier which is driven to rotate in the direction of arrow 33 about a horizontal axis which is at least substantially normal to the direction of advancement of the flow of tobacco particles in the duct 22. The carding at the periphery of the rotary carrier entrains a homogeneous layer of particles from the discharge end of the duct 22 and advances successive increments of such layer into the range of a rapidly rotating picker roller 37 which is driven to rotate in a clockwise direction, as viewed in FIG. 1.

A smoothing device 36 including one or more tobacco contacting members which are driven to oscillate above the tobacco flow in parallelism with the axis of the conveyor 34 are installed above the discharge end of the duct 22.

The picker roller is driven at an RPM preferably exceeding (for example, several times) the RPM of the carded conveyor 34. The particles which are expelled by the roller 37 are caused to descend in a relatively short substantially upright chute 38 having a sidewall 39 which slopes downwardly from the bottom wall and at the discharge end of the duct 22 and is located in the path of particles being propelled by the picker roller 37. The sidewall 39 can constitute a downwardly sloping extension of the bottom wall of the duct 22 at the conveyor 34.

The lower portion of the chute 38 communicates with a horizontal channel 41 serving to receive all or nearly all satisfactory tobacco particles for delivery toward the rod forming station or stations. The right-hand portion of the chute 38 beneath the sidewall 39 contains one or more nozzles 42 which discharge jets or streams of compressed air to propel the satisfactory tobacco particles into the channel 41. The latter is disposed below one or more additional nozzles 43 which discharge jets or streams of compressed air to assist the nozzle or nozzles 42 in propelling the particles toward the concave side of a guide wall 44. The nozzle or nozzles 46 at the guide wall 44 discharge additional jets of compressed air which cause the particles of tobacco to advance against the underside of the lower reach of a single foraminous belt conveyor or against the undersides of plural foraminous belt conveyors beneath a suction chamber 47. The manner in which the tobacco particles are gathered to form one or more streams which are trimmed to be converted into rod-like fillers ready for draping into cigarette paper or other wrapping material forms no part of the present invention. Reference may be had to the aforementioned commonly owned U.S. Pat. No. 4,893,640 to Heitmann et al.

The lowermost portion of the chute 38 is located beneath the channel 41 and serves to convey relatively heavy particles (e.g., fragments of tobacco ribs) into the range of a driven cell wheel 51 serving to evacuate such undesirable particles from the distributor. The evacuated heavier particles are collected in a receptacle 53. Any lighter (satisfactory) particles which are entrained by the evacuated heavier particles into the receptacle are transported upwardly toward the discharge end of the horizontal channel 41 by a pneumatic conveyor 52 defining an upright passage and cooperating with one or more nozzles 54 which discharge compressed air to first draw and to thereupon propel satisfactory particles from the receptacle 53 into the path of the carpet of particles leaving the channel 41.

Surplus air entering the space above the guide wall 44 is evacuated through a screen 48 and into the suction intake of a pneumatic conveyor 49.

The operation of the distributor which is shown in FIG. 1 is as follows:

When necessary, the gate 6 is pivoted to the open position to thus permit a batch of tobacco particles delivered by the conveyor 1 to descend into the magazine 7. The compartment 9 receives one or more streams of trimmed off surplus tobacco or one or more other types of tobacco from the conveyor 11 and such tobacco particles descend into the range of the combing roller 17. The latter cooperates with the metering device 16 to deliver a shower of intermixed and loosened tobacco particles into the path which is defined by the wall 18 and ramp 19. Metallic particles 56 (if any) are attracted by the magnet or magnets 21 and other impurities 57 (such as fragments of rock) descend onto the ramp 27 to be guided into the receiving or collecting device 28. The satisfactory particles which enter the receiving section of the duct 22 above the ramp 27 are acted upon by the agitated walls of the duct to advance in a direction to the left and to form a homogeneous flow which advances toward the discharge end of the duct 22, i.e., into the range of the driven conveyor 34. The contents of the receiving device are evacuated continuously or at desired intervals.

The operation of the eccentric drive 24 is selected and the rate of delivery of particles between the wall 18 and the ramp 19 is regulated in such a way that the duct 22 conveys a continuous flow which extends all the way to the underside of the top wall 31. Any surplus which is delivered to the receiving section of the duct 22 above the ramp 27 is brushed back by the rotating combing device 29. The monitoring device 32 ensures that the rate of admission of tobacco particles into the duct 22 is altered when necessary so that the consistency of successive increments of the flow advancing into the range of carding on the conveyor 34 remains at least substantially unchanged.

The picker roller 37 expels tobacco particles from the carding of the conveyor 34 and propels them against the sidewall 39 so that the particles descend in the chute 38 and at least the major part of the descending shower is propelled into the channel 41 and thence onto and along the guide wall 44 under the action of jets of compressed air issuing from the nozzles 42, 43 and 46. Heavier particles descend across the curtain of compressed air issuing from the nozzle or nozzles 42 and are evacuated by the cell wheel 51 to enter the receptacle 53. Any higher (satisfactory) particles which happen to enter the receptacle 53 are lifted in the conveyor 52 under the action of jets of compressed air issuing from the nozzle or nozzles 54 to enter the layer or carpet of particles advancing from the channel 41 onto the guide wall 44.

The wide carpet of tobacco particles on the guide wall 44 is directed toward the conveyor or conveyors at the suction chamber 47 to be converted into one or more streams which, in turn, are converted into one or more rod-like tobacco fillers.

Figure 2:
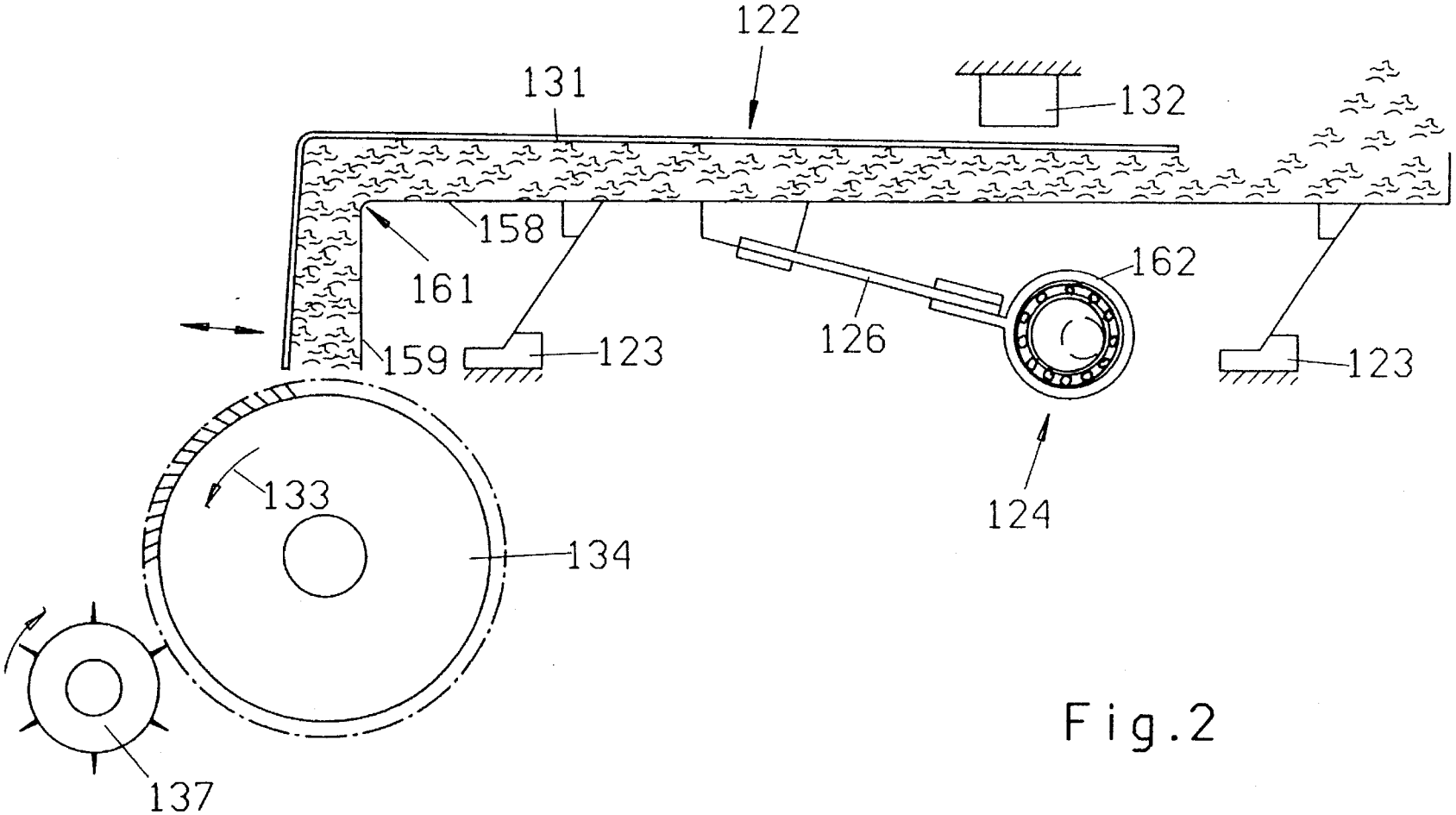
FIG. 2 is an enlarged fragmentary partly elevational and partly vertical sectional view of a modified duct which can be utilized in the improved distributor and includes an intermediate section having an elongated at least substantially horizontal first part extending from the receiving section toward the discharge end and a vertically downwardly extending second part between the first part and the conveyor.

That portion of a modified distributor which is shown in FIG. 2 includes a different duct 122. All such parts of the structure shown in FIG. 2 which are identical with or analogous to the corresponding parts of the distributor of FIG. 1 are denoted by similar reference characters plus 100.

The duct 122 of FIG. 2 comprises a receiving section to the right of the monitoring device 132, a discharge end at the top of the carded conveyor 134, and an elongated intermediate section including an elongated at least substantially horizontal part 158 extending from the receiving section toward but short of the conveyor 134, and a relatively short substantially vertical part 159 extending from the part 158 downwardly and to the conveyor 134. The parts 158, 159 define a pronounced deflection zone 161 where the direction of the flow of tobacco particles from the receiving section of the duct 122 to the conveyor 134 is changed through an angle of substantially 90°.

Whereas the top wall 31 of the duct 22 of FIG. 1 does not or need not vibrate with the bottom wall, the top wall of the part 158 of the intermediate section of the duct 122 is agitated with the bottom wall and with the walls of the part 159. The cross-sectional area of the duct 122 increases gradually at least substantially all the way from the receiving section to the discharge end. Thus, the top wall of part 158 diverges upwardly from the substantially horizontal bottom wall all the way to the deflection zone 161, and the illustrated walls of the part 159 diverge from the zone 161 all the way to the discharge end of the duct 122.

It has been found that the duct 122 can furnish to the conveyor 134 a highly satisfactory homogeneous flow of tobacco particles, even if the top wall of the part 158 is not agitated with the bottom wall.

The agitating means for the duct 122 of FIG. 2 comprises an eccentric drive 124 having a motor-driven eccentric surrounded by a strap 162 which is connected to the adjacent end of a rod 126 including or consisting of one or more elongated leaf springs. The left-hand end of the leaf spring or springs of the rod 126 need not be articulately connected to the bottom wall of the elongated horizontal part 158 of the intermediate section of the duct 122. The provision of a connecting rod in the form of one or more leaf springs which need not be articulately connected to the eccentric, to the strap 162 and/or to the duct 122 contributes to longer useful life of the drive 124.

Experiments with the improved distributor indicate that the duct 22 or 122 can deliver to the conveyor 34 or 134 a highly satisfactory flow of tobacco particles even if the duct or at least a portion of the duct is not horizontal. Thus the duct can slope slightly downwardly in or counter to the direction of advancement of the flow without appreciably affecting the quality and the rate of advancement of the flow. Furthermore, and as already pointed out above, the operation of the duct is satisfactory if the top wall of its intermediate portion is agitated with the bottom wall (FIG. 2) or if the top wall (31 in FIG. 1) remains stationary.

The smoothing device 36 contributes to more satisfactory advancement and consistency of successive increments of the flow advancing toward and beyond the discharge end of the duct 22.

Chute 38 need not be sealed or completely sealed from the surrounding atmosphere because the sidewall 39 is positioned to intercept the particles leaving the carding of the conveyor 34 and to steer the intercepted particles into the lower portion of the chute 38.

The duct 122 exhibits the advantage that the change of direction of advancement of the flow from the horizontal path defined by the part 158 into the vertical path defined by the part 159 ensures highly satisfactory and desirable filling of evential cavities in the flow. Moreover, the duct 122 exhibits the advantage that it can form a satisfactory flow even if the combing device 29 and/or the smoothing device 36 of the distributor shown in FIG. 1 is omitted. This is due to the provision of the agitated vertical part 159 of the intermediate section of the duct 122. The vertical part 159 moves back and forth at the discharge end of the duct 122 which ensures satisfactory and uniform filling of the carding of the conveyor 134 with tobacco particles. The feature that the cross-sectional area of the duct 122 increases gradually at least substantially all the way from the receiving section to the discharge end also contributes to the formation of a more satisfactory flow which can be converted into a homogeneous layer of particles in the carding of the conveyor 134.

The eccentric drive 124 can stand long periods of uninterrupted use even though it must agitate the duct 122 at a very high frequency. The leaf spring or leaf springs which form part of or constitute the connecting rod 126 are not subject to any wear in contrast to a connecting rod which is shown at 26 in FIG. 1 and which must be articulately connected to the bottom wall of the duct 22 as well as to the eccentric of the drive 24.

An important advantage of the novel combination of duct 22 or 122 and conveyor 34 or 134 is that it renders it possible to considerably reduce the overall height of the distributor without affecting the quality of the body of tobacco particles reaching the conveyor. Thus, if the entire duct 22 or 122 were vertical, the overall height of the distributor would have to be increased accordingly. The tobacco flow which reaches the conveyor 34 or 134 is homogeneous (devoid of cavities), uniform and can be delivered to the conveyor 34 or 134 at a rate which is required in a high speed cigarette maker or an analogous machine. This, in turn, ensures that the stream or streams formed by tobacco particles advancing beyond the guide wall 44 are also satisfactory and can be converted into high-quality rod-like tobacco fillers.

Without further analysis, the foregoing will so fully reveal the gist of the present invention that others can, by applying current knowledge, readily adapt it for various applications without omitting features that, from the standpoint of prior art, fairly constitute essential characteristics of the generic and specific apects of the above outlined contribution to the art and, therefore, such adaptations should and are intended to be comprehended within the meaning and range of equivalence of the appended claims.

What is claimed is:

1. A distributor for particles of smokable material, comprising a carded conveyor rotatable about a predetermined axis; means for delivering to said conveyor an at least substantially continuous flow of particles including a duct having a discharge end at said conveyor, a particle receiving section, and an elongated intermediate section between said receiving section and said discharge end, at least a major part of said intermediate section being at least substantially horizontal; means for agitating at least a portion of said duct to thereby advance the flow in a direction from said receiving section to said discharge end; and means for smoothing the flow of particles at said discharge end, comprising a flow contacting member which is driven to oscillate in at least substantial parallelism with said axis.

2. The distributor of claim 1, further comprising means for receiving particles from said conveyor, including a chute having a sidewall sloping downwardly from a bottom wall of said duct at said discharge end beneath said conveyor.

3. The distributor of claim 1, further comprising means for supplying to said receiving section a mixture of magnetizable and nonmagnetizable particles along a predetermined path, and means for attracting magnetizable particles, said attracting means being adjacent said path at said receiving section.

4. The distributor of claim 1, wherein said duct comprises a top wall above an upper surface of the flow of particles in said duct, and further comprising means for monitoring the level of the upper surface of the flow beneath said top wall.

5. A distributor for particles of smokable material, comprising a carded conveyor; means for delivering to said conveyor an at least substantially continuous flow of particles including a duct having a discharge end at said conveyor, a particle receiving section, an elongated intermediate section between said receiving section and said discharge end and a bottom wall including a ramp and being disposed at said receiving section, at least a major part of said intermediate section being at least substantially horizontal; and means for agitating at least a portion of said duct to thereby advance the flow in a first direction from said receiving section to said discharge end, said ramp sloping downwardly in a second direction counter to said first direction.

6. The distributor of claim 5, further comprising means for supplying to said receiving section a mixture of lighter particles and heavier particles so that the heavier particles descend onto and advance along said ramp, and means for receiving heavier particles from said ramp.

7. A distributor for particles of smokable material, comprising a carded conveyor; means for delivering to said conveyor an at least substantially continuous flow of particles including a duct having a discharge end at said conveyor, a particle receiving section and an elongated intermediate section between said receiving section and said discharge end, said intermediate section including a substantially horizontal part extending from said receiving section toward but short of said discharge end and a substantially vertical part extending from said substantially horizontal part to said discharge end; and means for agitating said duct to thereby advance the flow in a direction from said receiving section to said discharge end.

8. The distributor of claim 7, further comprising means for smoothing the flow of particles at the discharge end of said duct.

9. The distributor of claim 8, wherein said conveyor is rotatable about a predetermined axis and said smoothing means comprises a flow contacting member which is driven to oscillate in at least substantial parallelism with said axis.

10. The distributor of claim 7, wherein said conveyor includes a drum rotatable about a substantially horizontal axis and having a top portion beneath said discharge end.

11. The distributor of claim 7, wherein said duct has a cross-sectional area which increases at least substantially continuously from said receiving section to said discharge end.

12. The distributor of claim 7, wherein said intermediate section includes a first wall and a second wall located opposite said first wall and diverging from said first wall in said direction from said receiving section and at least close to said discharge end.

13. The distributor of claim 12, wherein said intermediate section includes a top wall forming part of one of said first and second walls.

14. The distributor of claim 7, wherein said agitating means comprises an eccentric drive having a connecting rod including at least one leaf spring.

15. The distributor of claim 14, wherein said drive further includes a rotary eccentric and a strap at least partially surrounding said eccentric and connected with said rod.

16. The distributor of claim 7, further comprising means for supplying to said receiving section a mixture of magnetizable and nonmagnetizable particles along a predetermined path, and means for attracting magnetizable particles, said attracting means being adjacent said path at said receiving section.

17. The distributor of claim 7, wherein said duct comprises a top wall above an upper surface of the flow of particles in said duct, and further comprising means for monitoring the level of the upper surface of the flow beneath said top wall.

* * * * *